US009403068B2

(12) United States Patent
Golden et al.

(10) Patent No.: US 9,403,068 B2
(45) **Date of Patent: *Aug. 2, 2016**

(54) GOLF CLUB HEAD HAVING A GROOVED AND TEXTURED FACE

(71) Applicant: Acushnet Company, Fairhaven, MA (US)

(72) Inventors: Charles E. Golden, Encinitas, CA (US); Peter J. Gilbert, Pinehurst, NC (US); Robert W. Vokey, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 75 days.

This patent is subject to a terminal disclaimer.

(21) Appl. No.: 13/975,043

(22) Filed: Aug. 23, 2013

(65) Prior Publication Data

US 2013/0344984 A1 Dec. 26, 2013

Related U.S. Application Data

(63) Continuation of application No. 13/412,369, filed on Mar. 5, 2012, now Pat. No. 8,517,861, which is a continuation of application No. 13/180,488, filed on Jul. 11, 2011, now Pat. No. 8,128,511, which is a continuation of application No. 12/339,378, filed on Dec. 19, 2008, now Pat. No. 7,976,404, which is a continuation-in-part of application No. 12/107,280, filed on Apr. 22, 2008, now Pat. No. 7,758,449, which is a continuation-in-part of application No. 12/007,223, filed on Jan. 8, 2008, now Pat. No. 7,862,450, which is a continuation-in-part of application No. 11/711,096, filed on Feb. 27, 2007, now Pat. No. 7,568,983, which is a continuation-in-part of application No. 10/902,064, filed on Jul. 30, 2004, now Pat. No. 7,273,422.

(60) Provisional application No. 60/528,708, filed on Dec. 12, 2003.

(51) Int. Cl.
*A63B 53/04* (2015.01)

(52) U.S. Cl.
CPC ..... *A63B 53/04* (2013.01); *A63B 53/047* (2013.01); *A63B 2053/0445* (2013.01)

(58) Field of Classification Search
CPC ..... A63B 2053/0445; A63B 53/04; A63B 53/047
USPC ..... 473/330–331; D21/750–751
See application file for complete search history.

(56) References Cited

U.S. PATENT DOCUMENTS

| | | | |
|---|---|---|---|
| 732,136 | A | 6/1903 | Taylor |
| 1,536,616 | A | 5/1925 | Manning |
| 3,869,126 | A | 3/1975 | Thompson |
| 4,413,825 | A | 11/1983 | Sasse |
| 4,508,349 | A | 4/1985 | Gebauer et al. |

(Continued)

FOREIGN PATENT DOCUMENTS

JP 09-253250 9/1997

*Primary Examiner* — Sebastiano Passaniti
(74) *Attorney, Agent, or Firm* — Michael J. Mancuso

(57) ABSTRACT

A golf club head with an improved striking surface. The grooves are machined into the strike surface with tight tolerances. The face may be selectively textured to enhance certain shots that the golfer may perform. This may include providing a plurality of distinct sets of texturing and surface roughening to accommodate a plurality of different shots.

20 Claims, 13 Drawing Sheets

(56) References Cited

U.S. PATENT DOCUMENTS

| | | | | |
|---|---|---|---|---|
| 4,529,203 | A | 7/1985 | Ribaudo | |
| 4,858,929 | A | 8/1989 | Long | |
| 4,869,508 | A | 9/1989 | Miller | |
| 4,902,016 | A | 2/1990 | Boone | |
| 5,437,088 | A | 8/1995 | Igarashi | |
| 5,505,450 | A | 4/1996 | Stuff | |
| 5,591,092 | A | 1/1997 | Gilbert | |
| 5,618,239 | A | 4/1997 | Rife | |
| 5,637,044 | A | 6/1997 | Swash | |
| 5,688,186 | A | 11/1997 | Michaels et al. | |
| 5,690,561 | A | 11/1997 | Rowland et al. | |
| 5,755,626 | A | 5/1998 | Shira | |
| 6,099,414 | A | 8/2000 | Kusano et al. | |
| 6,224,497 | B1 | 5/2001 | Antonious | |
| 6,348,010 | B1 | 2/2002 | Doolen | |
| 6,348,011 | B1 | 2/2002 | Reyes et al. | |
| 6,605,006 | B2 | 8/2003 | Mason | |
| 6,733,400 | B2 | 5/2004 | Sherwood | |
| 6,739,984 | B1 | 5/2004 | Ciasullo | |
| 6,814,673 | B2 | 11/2004 | Wahl et al. | |
| 6,849,004 | B2 | 2/2005 | Lindsay | |
| 6,890,270 | B2 | 5/2005 | Ciasullo | |
| 7,014,568 | B2 | 3/2006 | Pelz | |
| 7,056,226 | B2 | 6/2006 | Kennedy | |
| 7,273,422 | B2 | 9/2007 | Vokey et al. | |
| 7,285,057 | B2 | 10/2007 | Mann, Jr. et al. | |
| 7,473,187 | B2 | 1/2009 | Vokey et al. | |
| 7,568,983 | B2 | 8/2009 | Gilbert | |
| 7,594,862 | B2 | 9/2009 | Gilbert | |
| 7,594,863 | B2 | 9/2009 | Ban | |
| 7,653,980 | B2 | 2/2010 | Vokey et al. | |
| 7,658,685 | B2 | 2/2010 | Vokey et al. | |
| 7,674,188 | B2 | 3/2010 | Ban | |
| 7,677,990 | B2 | 3/2010 | Ban | |
| 7,691,007 | B2 | 4/2010 | Ban et al. | |
| 7,695,377 | B2 | 4/2010 | Yamagishi et al. | |
| 7,758,449 | B2 * | 7/2010 | Gilbert et al. | 473/330 |
| 7,815,521 | B2 | 10/2010 | Ban et al. | |
| 7,819,756 | B2 | 10/2010 | Ban et al. | |
| 7,846,039 | B2 | 12/2010 | Gilbert et al. | |
| 7,862,450 | B2 | 1/2011 | Gilbert et al. | |
| 7,878,923 | B2 | 2/2011 | Yamagishi et al. | |
| 7,905,797 | B2 | 3/2011 | Gilbert et al. | |
| 7,909,708 | B2 | 3/2011 | Gilbert | |
| 7,918,747 | B2 | 4/2011 | Johnson et al. | |
| 7,955,189 | B2 | 6/2011 | Vokey et al. | |
| 7,976,404 | B2 * | 7/2011 | Golden et al. | 473/330 |
| 7,976,405 | B2 | 7/2011 | Gilbert et al. | |
| 7,976,406 | B2 * | 7/2011 | Gilbert et al. | 473/330 |
| 8,109,840 | B2 | 2/2012 | Gilbert et al. | |
| 8,128,510 | B2 | 3/2012 | Gilbert | |
| 8,128,511 | B2 * | 3/2012 | Golden et al. | 473/330 |
| 8,128,512 | B2 | 3/2012 | Gilbert et al. | |
| 8,128,513 | B2 * | 3/2012 | Gilbert et al. | 473/330 |
| 8,142,309 | B2 | 3/2012 | Johnson et al. | |
| 8,210,966 | B2 | 7/2012 | Gilbert et al. | |
| 8,240,021 | B2 | 8/2012 | Gilbert et al. | |
| 8,287,401 | B2 | 10/2012 | Tateno et al. | |
| 8,348,784 | B2 | 1/2013 | Gilbert et al. | |
| 8,517,861 | B2 * | 8/2013 | Golden et al. | 473/330 |
| 2009/0313806 | A1 | 12/2009 | Gilbert | |
| 2011/0118054 | A1 | 5/2011 | Johnson et al. | |

* cited by examiner

GOLF CLUB HEAD HAVING A GROOVED AND TEXTURED FACE

CROSS-REFERENCE TO RELATED APPLICATIONS

This is a continuation of U.S. patent application Ser. No. 13/412,369, filed on Mar. 5, 2012, which is a continuation of U.S. patent application Ser. No. 13/180,488, filed on Jul. 11, 2011, now U.S. Pat. No. 8,128,511, which is a continuation of U.S. patent application Ser. No. 12/339,378, filed on Dec. 19, 2008, now U.S. Pat. No. 7,976,404, which is a continuation-in-part of U.S. patent application Ser. No. 12/107,280, filed on Apr. 22, 2008, now U.S. Pat. No. 7,758,449, which is a continuation-in-part of U.S. patent application Ser. No. 12/007,223, filed on Jan. 8, 2008, now U.S. Pat. No. 7,862,450, which is a continuation-in-part of U.S. patent application Ser. No. 11/711,096, filed on Feb. 27, 2007, now U.S. Pat. No. 7,568,983, which is a continuation-in-part of U.S. patent application Ser. No. 10/902,064, filed on Jul. 30, 2004, now U.S. Pat. No. 7,273,422, which are incorporated herein by reference in their entireties.

This application claims the benefit of U.S. Provisional Patent Application No. 60/528,708 filed on Dec. 12, 2003, which is incorporated herein by reference in its entirety.

BACKGROUND OF THE INVENTION

1. Field of the Invention

The present invention relates to golf clubs. In particular, the present invention relates to a golf club head having an improved striking surface.

2. Description of the Related Art

Golf club heads come in many different forms and makes, such as wood- or metal-type, iron-type (including wedge-type club heads), utility- or specialty-type, and putter-type. Each of these styles has a prescribed function and make-up.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The United States Golf Association (USGA) publishes and maintains the Rules of Golf, which govern golf in the United States. Appendix II to the USGA Rules provides several limitations for golf clubs. For example, the width of a groove cannot exceed 0.035 inch, the depth of a groove cannot exceed 0.020 inch, and the surface roughness within the area where impact is intended must not exceed that of decorative sand-blasting or of fine milling. The Royal and Ancient Golf Club of St Andrews, which is the governing authority for the rules of golf outside the United States, provides similar limitations to golf club design.

U.S. Pat. No. 6,814,673 is directed to grooves for iron-type golf clubs.

SUMMARY OF THE INVENTION

The present invention relates to golf clubs. In particular, the present invention relates to a golf club head having an improved striking surface. The golf club head of the present invention has a flat striking face, preferably being milled. This allows a greater degree of flatness than typically seen. Preferably, the face is flat within ±0.002 inch. Grooves or score lines are then cut into the flattened face. Typically, grooves are formed in the face as part of the head-forming process. For example, if the head is cast, typical grooves are formed as part of the casting process. The face—including the grooves—is then subject to post-casting process steps, such as polishing. Similar finishing steps are also typically performed on club heads that are formed by forging. Machining grooves in the face after it has been milled beneficially saves them from being affected by any face post-manufacturing processes, which can adversely effect, for example, the groove-face interface, making it inconsistent along the length of the groove.

Preferably, a golf club head includes a body having a striking face. The striking face includes a plurality of grooves that extend into the body from the striking face. The striking face also includes at least one region of directional texturing that is interposed between adjacent grooves. The region of directional texturing includes a plurality of ridges that are spaced by 0.005 inch to 0.030 inch.

In another embodiment, a golf club head includes a body having a striking face. The striking face includes a plurality of grooves extending into the body from the striking face and at least one region of directional texturing. The region of directional texturing is interposed between adjacent grooves and includes a plurality of ridges having triangular cross-sectional shape.

In another embodiment, a golf club head includes a body having a striking face. The striking face includes a plurality of grooves extending into the body from the striking face and at least one region of directional texturing. The region of directional texturing is interposed between adjacent grooves and includes a plurality of ridges having rectangular cross-sectional shape.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
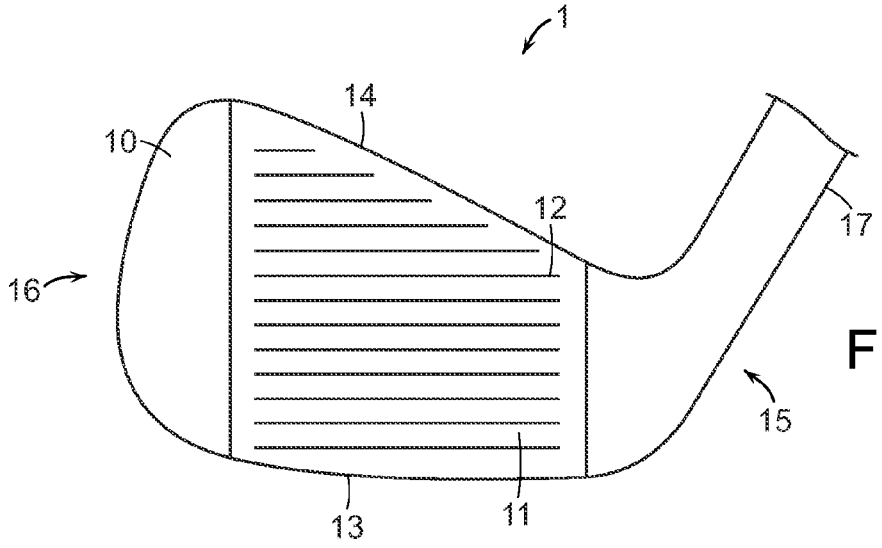
FIG. 1 shows a golf club head of the present invention.

The present invention is directed to a golf club head with an improved striking surface. FIG. 1 shows a golf club head 1 of the present invention. The golf club head 1 includes a body 10 defining a front surface 11, a sole 13, a top line 14, a heel 15, a toe 16, and a hosel 17. The striking face of the front surface 11, which contains grooves 12 therein, and the sole 13 may be unitary with the body 10, or they may be separate bodies, such as inserts, coupled thereto. While the club head 1 is illustrated as an iron-type golf club head, the present invention may also pertain to a utility-type golf club head or a wood-type club head.

Figure 2:
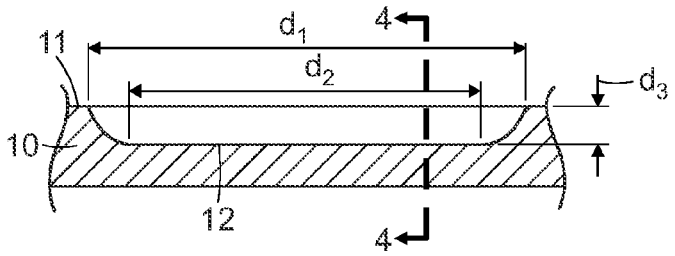
FIG. 2 shows a cross-sectional view of a club head of the present invention along a groove.

FIG. 2 shows a cross-sectional view of the club head 1 along a groove 12. Grooves 12 are machined into the surface of the striking face 11, which allows the draft angle to be decreased. Grooves 12 extend from a toe end of the club head 1 to a heel end of the club head 1. The grooves 12 are shallow at both the toe and heel portions of the club head 1, and are deep in the central regions. Grooves 12 have a first distance d1 measured along the surface of striking face 11 and a second distance d2 measured along the deepest portion of the grooves, which have a depth d3. Thus, first distance d1 is an overall distance and second distance d2 is a maximum depth distance. Preferably, the groove depth along the maximum depth distance d2 is substantially constant. In one embodiment the maximum depth distance d2 is at least 0.25 inch shorter than the overall distance d1. The groove draft angle $\alpha$ ranges from about 0.5° to 12°, more preferably about from 4° to 6°, and most preferably 5°.

Figure 3:
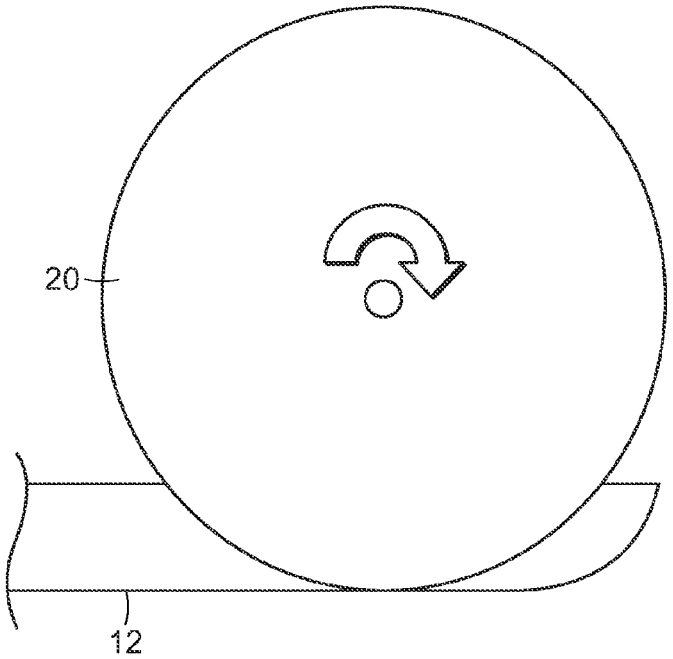
FIG. 3 shows a preferred groove cutting setup.

Grooves 12 are radiused at the toe and heel portions of the club head 1, and are about 0.02 inch deep at a geometric center of the face 11. Grooves 12 are machined into the strike face surface 11. The club head 1 is retained in a mold, which preferably is formed of a material soft enough to not damage the club head 1 yet resilient enough to firmly retain the golf club head 1, and a cutter, preferably a round cutter or a saw cutter, is used to form the grooves 12. As shown, the toe and heel portions are radiused about an axis of rotation that is perpendicular to a longitudinal axis of the groove. Furthermore, that axis of rotation is approximately parallel to face 11 of club head 1. Preferred cutters have a diameter from ⅜ inch to ¾ inch. A preferred range of groove radii include from 0.125 inch to 5 inches, with 0.25 inch to 2.5 inches being more preferred. Having radiused grooves 12 facilitates removal of dirt, grass, sand, and other materials that typically become embedded within the grooves of a golf club during normal use by eliminating corners that can trap these materials. FIG. 3 shows a preferred groove cutting setup illustrating cutter 20 with groove 12.

Figure 4:
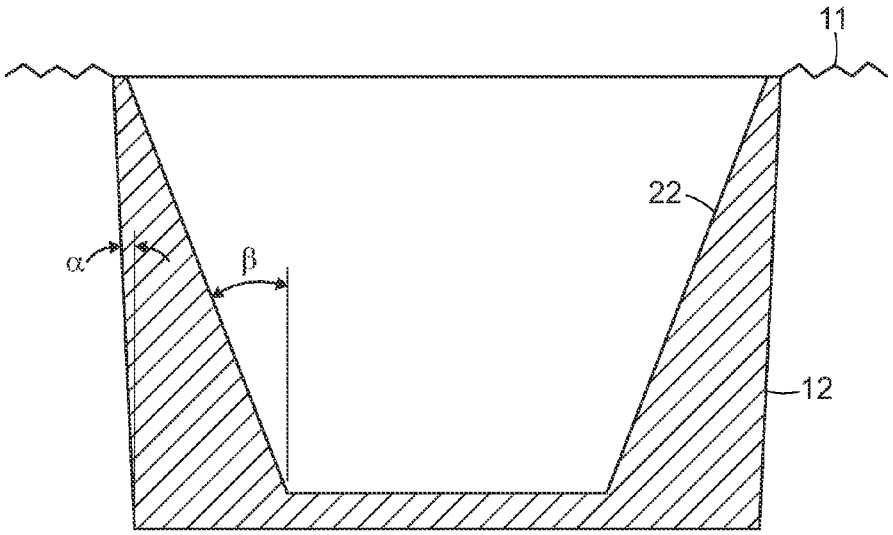
FIG. 4 shows a comparison of a groove of the golf club head of FIG. 1 as viewed along lines 4-4 of FIG. 2 with a known groove.

Machining the grooves 12, in addition to decreasing the draft angle, increases the rate of production and allows for tighter tolerances than casting or forging. The rate of production is increased by decreasing the number of required manufacturing steps. Instead of inserting the tool into the club face, machining the grooves, and removing the tool from the club face in three separate steps, as required by known groove creating processes, the present invention allows all three to be combined into one step. This is possible because the turning axis of the present cutter is parallel to the face, rather than the perpendicular axes of known processes. The tighter tolerances possible with the present invention allow less material to be removed, also decreasing manufacturing time. FIG. 4 shows a comparison of a groove 12 of the present invention with a typical groove 22 of known golf club heads. The groove 12 preferably has a depth of 0.02 inch, which is the USGA limit. Due to loose tolerances, known grooves 22 were designed well short of this limit. Similarly, known manufacturing processes required a large draft angle $\beta$, typically around 16°. The draft angle $\alpha$ of grooves 12 is much smaller, increasing the cross-sectional area of the groove and groove volume for a given length.

As noted above, the governing bodies of golf place limitations of the geometry of grooves 12. The increased tolerance control afforded by machining the grooves 12 of the present invention allows the actual groove geometry to be closer to the limits than was previously achievable. Thus, the grooves 12 of the present invention maximize groove volume, enhancing the groove performance during use. With the improved grooves of the present invention, the grooves better grip the ball, allowing a golfer to apply more spin to the ball. The golfer's control over the ball, both during ball flight and subsequent to flight, such as when landing and settling on a golf green, are increased. The grooves 12 of the present invention also result in a golf club head that is more aesthetically pleasing and that allows better ball control.

Figure 5:
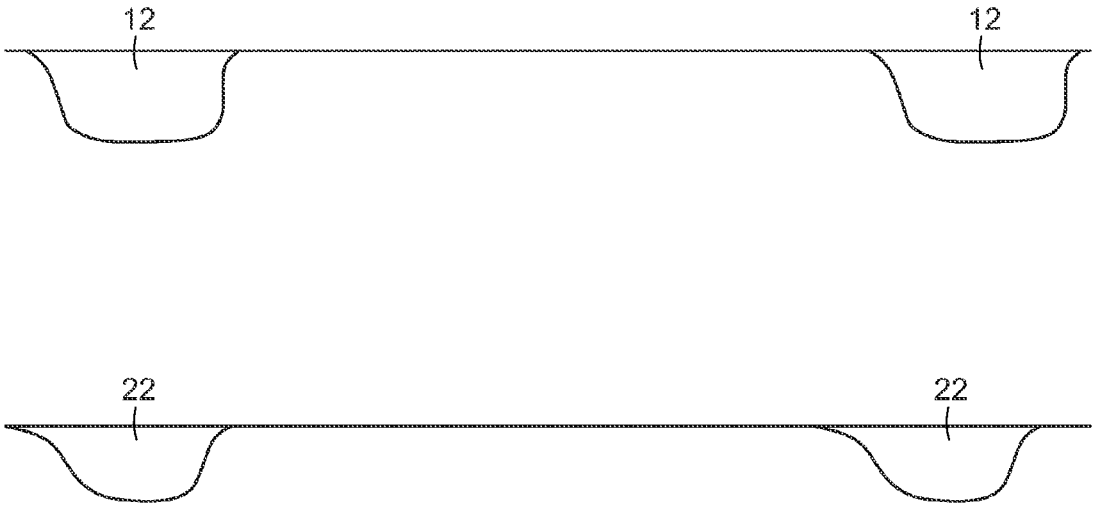
FIG. 5 shows a comparison of a groove of the golf club of FIG. 1 and a known groove.
Figure 6:
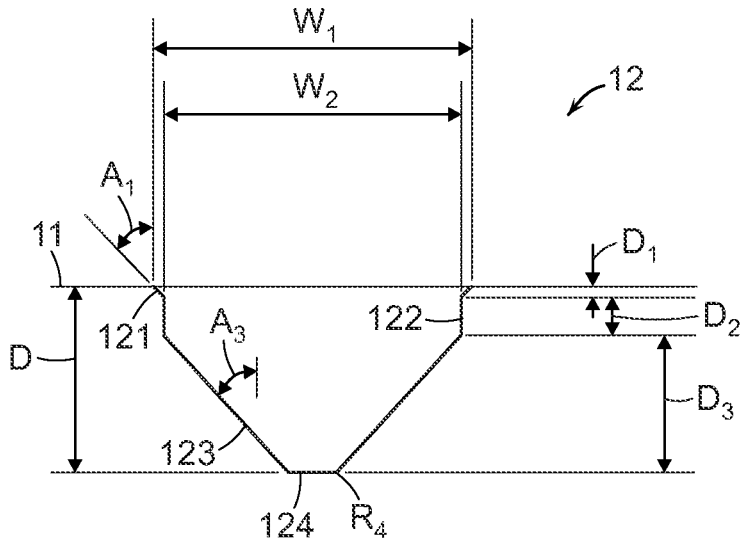
FIGS. 6-9 each show a cross-section of a preferred groove of the present invention.
Figure 7:
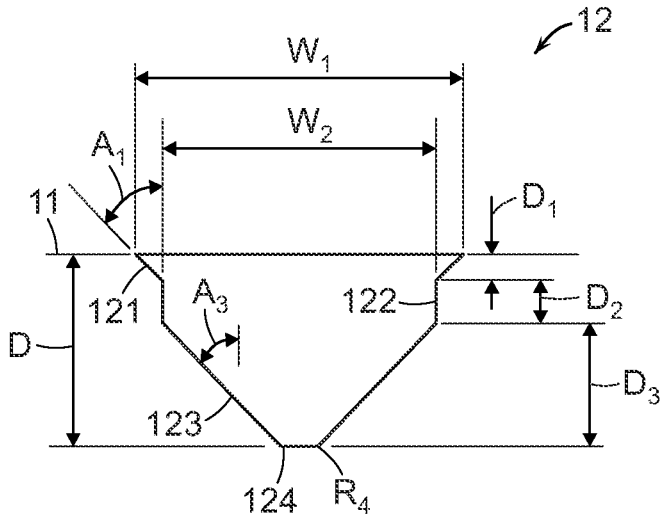
Figure 8:
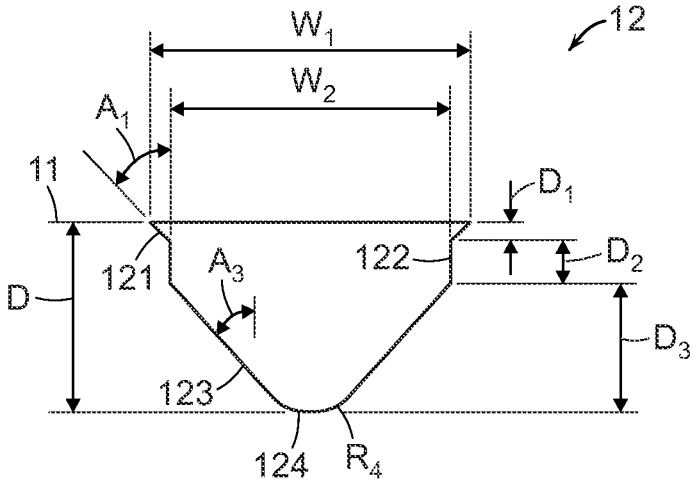
Figure 9:
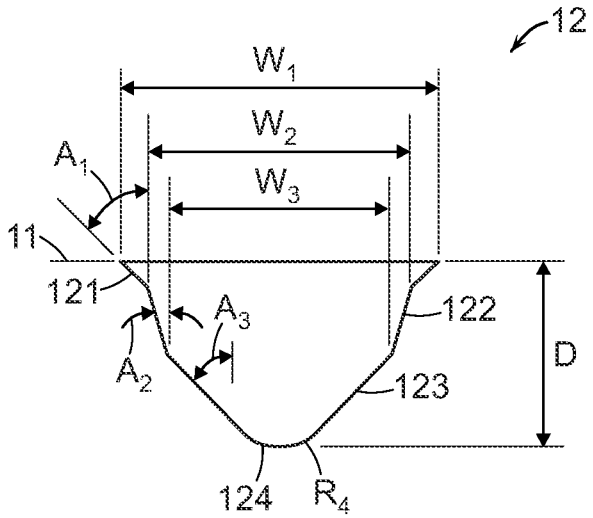

FIG. 5 shows a comparison of a groove 12 of the present invention with a typical groove 22 of known golf club heads. The known grooves 22 are quite rounded. The grooves 12 of the present invention, however, are much sharper. The edges are more defined, the depth is greater, and the dimensions are more consistent and closer to the limits. All of these factors allow the golf club head 1 to better grip the golf ball, increasing the user's control over the ball.

The face 11 of the club head 1 of the present invention is also enhanced to provide additional ball control and enhanced performance. The strike surface 11 is provided with a roughened texture. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)|dx$$

The face 11 is roughened by machining, preferably with a Computer Numerically Controlled (CNC) mill. Known golf clubs have a face roughness at most 40 Ra. At least a portion of the face 11 in the proximity of the grooves, and more preferably the entire face 11, is machined such that it has a substantially uniform textured surface with a roughness greater than 40 Ra. Preferably, the roughness is from 75 Ra to 300 Ra, more preferably from 100 Ra to 200 Ra, and most preferably from 120 Ra to 180 Ra.

Providing a textured strike face allows the golfer to apply more friction to the ball during use, allowing the golfer to put more spin on the ball and have greater control of the ball. Conventionally, golfers have to take a full swing to induce enough golf ball spin to control the ball movement on a golf green. With the golf club head of the present invention, a golfer can induce golf ball spin in "partial" shots, or shots when the golfer is not taking a full swing. The textured strike surface of the present invention also distributes the shear force resulting from the golf swing over a greater area of the golf ball. This reduces cover damage and extends golf ball life.

Preferably, the face is selectively textured to enhance playability. The face point of contact with the ball varies depending upon the particular golf shot being performed. If the ball is lying on the fairway and the golfer takes a "regular" swing, then the golfer strives to make contact with the ball on the lower portion of the club face, typically the lower, central portion of the club face. For a chip shot, the golfer may likely alter the club face angle, striking the ball higher on the club face. Of course, this would change the angular orientation of the club head relative to the golf ball at impact. For a flop shot, the golfer opens the club face to a large degree, further changing the face contact point and angular orientation. Still other portions of the face may be used for other types of shots; for example, some golfers use the extreme outer toe portion of the face, with the toe pointed toward the playing surface, as the ball contact point for chip shots. The face may therefore be selectively textured to enhance each of the different types of shots the golfer may perform.

Figure 15:
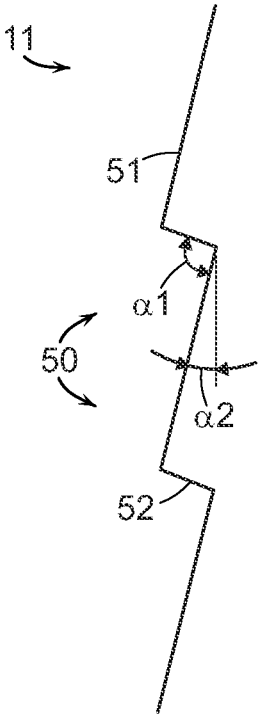
FIG. 15 shows a partial cross-sectional view of a golf club head striking face of the present invention.

FIGS. 15 and 23-31 each show a partial cross-sectional view of a golf club head striking face of the present invention including surface texture that may be created by milling, laser etching and/or chemical etching. FIG. 15 shows a close-up view of the texture left by a milling process in which the face 11 has been textured, such as by milling with a single direction of cutting. The result is a directionally textured face 11. The face surface 11 contains a plurality of notches 50 forming a plurality of ridges defined by a first, relatively long surface 51 and a second, relatively short surface 52. The top-to-bottom direction of travel in FIG. 15 is the "smooth" direction of travel, in that the notches 50 will not impede travel. The bottom-to-top direction of travel, again relative to FIG. 15, is the "notched" direction of travel, in that travel will be stopped at each notch wall junction. Another way of describing these surfaces 51, 52 is that the first surface 51 is a departing surface in that, in the smooth direction of travel, this surface departs away from a nominal vertical plane of the striking face surface 11. The second surface 52 can be described as a return or returning surface in that, in the smooth direction of travel, this surface returns to the nominal vertical plane, or nominal striking face plane. The second surface 52 is notched outward relative the golf ball, so it may impart some spin thereto during use of the resulting golf club. The notch surfaces 51, 52 define an exterior angle $\alpha_1$ therebetween, that may be an obtuse, acute or right angle, but is preferably acute. The first notch surfaces 51 extend outward relative a vertical plane at an internal angle $\alpha_2$. Preferably, the external angle $\alpha_1$ is greater than the internal angle $\alpha_2$, and more preferably the external angle $\alpha_1$ is greater than twice the internal angle $\alpha_2$.

Figure 16:
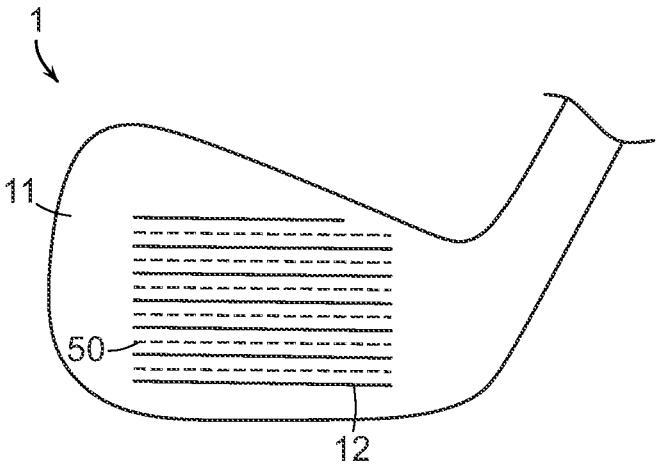
FIGS. 16-22 show front views of golf club heads of the present invention.

It will be noted that FIG. 15 shows only a portion of the strike face 11, and does not illustrate any grooves 12. The club head preferably also includes grooves, with the face being textured in between the grooves and/or in non-grooved areas of the face 11. One exemplary groove-texture combination is illustrated in FIG. 16, which shows a front view of a club head 1 of the present invention. The central portion of the club head 1 intermediate the heel and toe contains grooves 12. The face 11 is textured with notches 50 among the grooves 12 in the central portion of the club head. These notches are shown simply as dashed lines for the sake of clarity in the illustrated embodiments. The textured surface is not limited to the areas actually covered by the dashed lines. Rather, only a few lines are shown to indicate the texturing so that the figures do not become too crowded and unreadable. The notches are directed toward the sole, such as is illustrated in FIG. 15 (i.e., the top-to-bottom direction of travel is the "smooth" direction of travel). Thus, by using straight lines to illustrate the texturing in FIG. 16, it is shown that the notches are uniformly directed downward.

Figure 23:
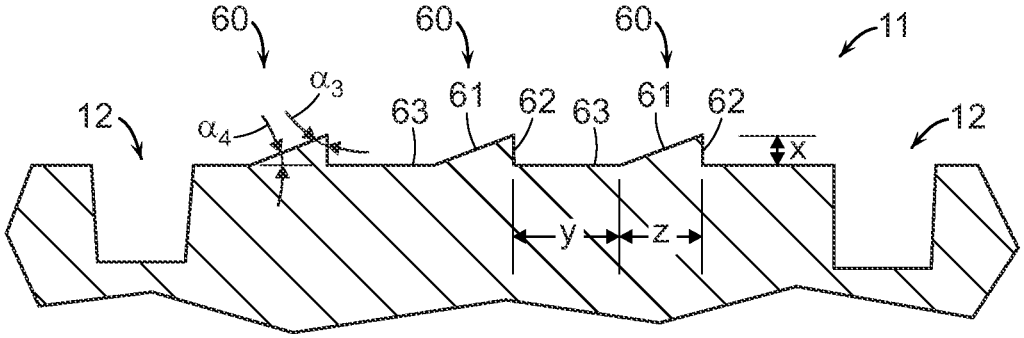
FIGS. 23-31 each show a cross-section of a portion of a golf club head striking face of the present invention.
Figure 24:
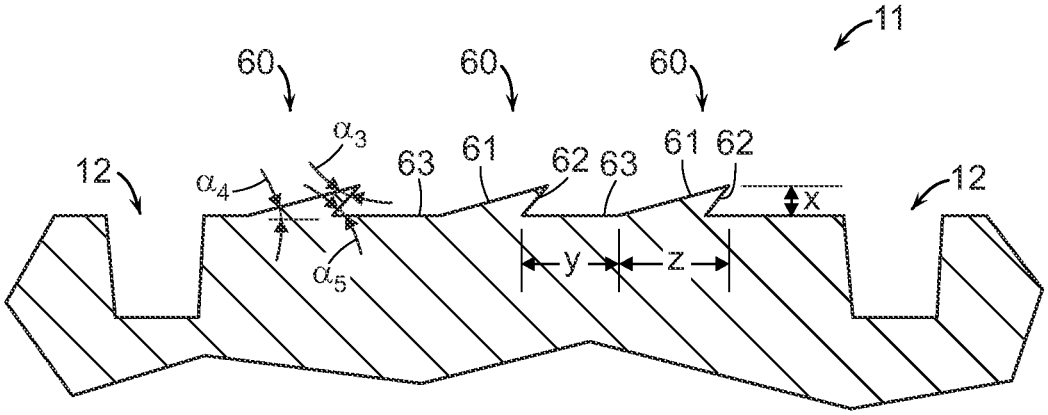

The face texture may also include a plurality of spaced ridges located between adjacent grooves that, in some embodiments, also provide a "smooth" direction of travel and a "notched" direction of travel. For example, referring to FIG. 23, ridges 60 are spaced by generally planar portions 63 of strike face 11. Preferably, planar portions 63 are also planar relative to each other and are oriented so that they are generally parallel to the intended loft plane of the golf club. As a result, planar portions 63 generally are located within a nominal striking face plane. Each of ridges 60 includes a first surface 61 and a second surface 62. First surface 61 is angled relative to planar portions 63 by an angle $\alpha_4$ and preferably oriented so that it extends further away from planar portions in a direction from a top line toward a leading edge of the golf club. Second surface 62 extends between the end of first surface 61 furthest from planar portion 63 and an end of planar portion 63 so that the ridges 60 generally form a saw-tooth pattern. Second surface 62 is angled relative to first surface 61 by an angle $\alpha_3$ that, in the embodiment of FIG. 23, is complimentary to angle $\alpha_4$ so that second surface 62 is approximately orthogonal to planar portion 63. In another embodiment, shown in FIG. 24, second surface 62 is angled relative to first surface 61 so that second surface 62 forms an acute external angle $\alpha_5$ relative to planar portion 63. It should be appreciated that angles $\alpha_3$ and $\alpha_5$ may be acute, obtuse or right angles.

Figure 25:
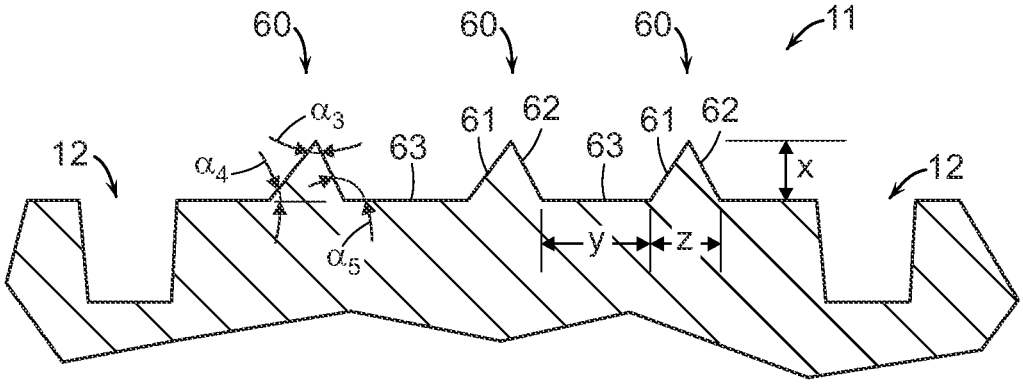
Figure 26:
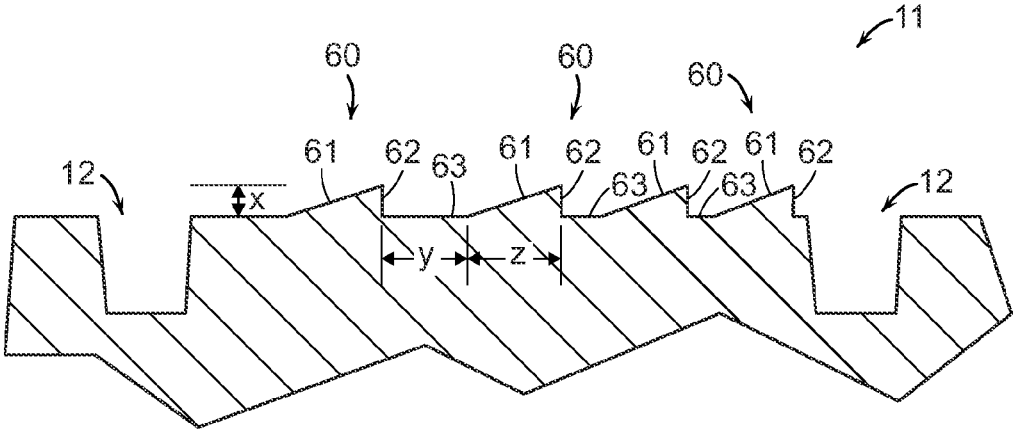

In another embodiment, shown in FIG. 25, first surface 61 and second surface 62 have approximately the same length so that, the ridges have an approximately equilateral triangular cross-section. In particular, angles $\alpha_4$ and $\alpha_5$ are approximately supplementary angles and angle $\alpha_3$ may be an acute, right or obtuse angle. In a further embodiment, shown in FIG. 26, the pitch of ridges 60 varies across surface 11. For example, ridges 60 are closer together in a portion of surface 11, such as a portion adjacent groove 12 that is on the leading edge side of a portion of front surface 11. The pitch may be altered by changing the length of portions 63. As a result of altering the pitch of ridges 60, the density of ridges 60 immediately adjacent groove 12 is greater on one side of groove 12 than on the other.

Figure 27:
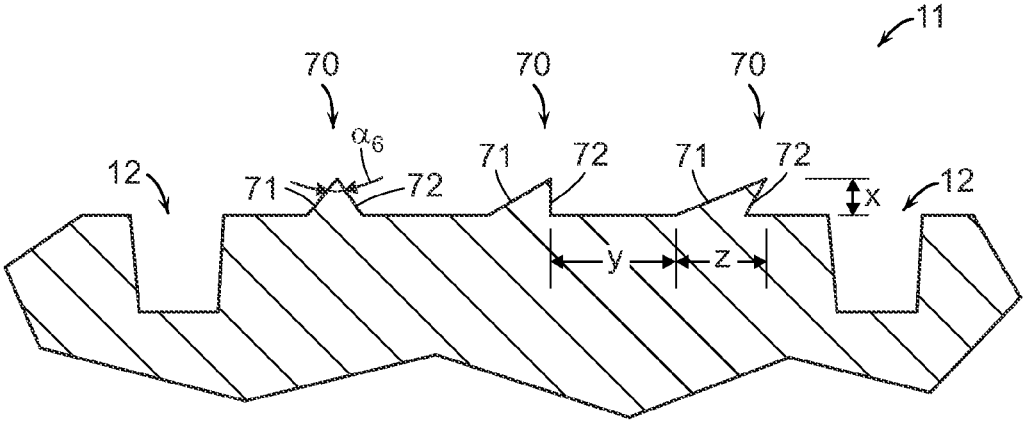

In other embodiments, surface 11 includes ridges having a progressive configuration between adjacent grooves 12. Referring to FIG. 27, a plurality of ridges 70 is provided between adjacent grooves 12 having first and second surfaces 71, 72 that vary in length and angle across the portion of surface 11. For example, a first ridge 70 includes a first surface 71 and a second surface 72 that have approximately equal lengths so that first ridge 70 has a generally equilateral triangular shaped cross-section. The first surface 71 increases in length progressively from the first ridge, while second surface 72 decreases in length and the resulting apex angle $\alpha_6$ decreases across surface 11. Preferably, the ridges progress so that apex angle $\alpha_6$ reduces in the direction from the top line toward the leading edge of the golf club.

Figure 28:
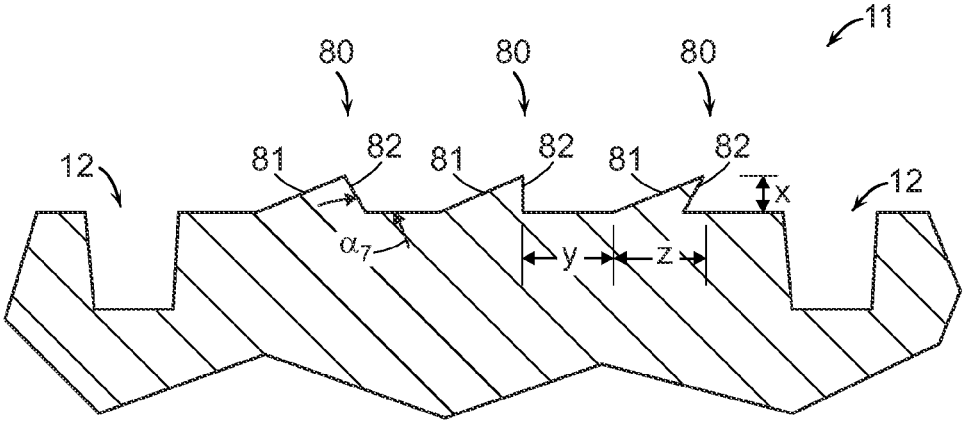

Referring to FIG. 28 and in another embodiment, the length and orientation of first surface 81 is held constant while the length and orientation of second surface 82 is altered progressively across surface 11. For example, the angle $\alpha_7$ of second surface 82 relative to surface 11 changes progressively between an obtuse and an acute angle and the length of second surface 82 varies accordingly to meet first surface 81.

Figure 29:
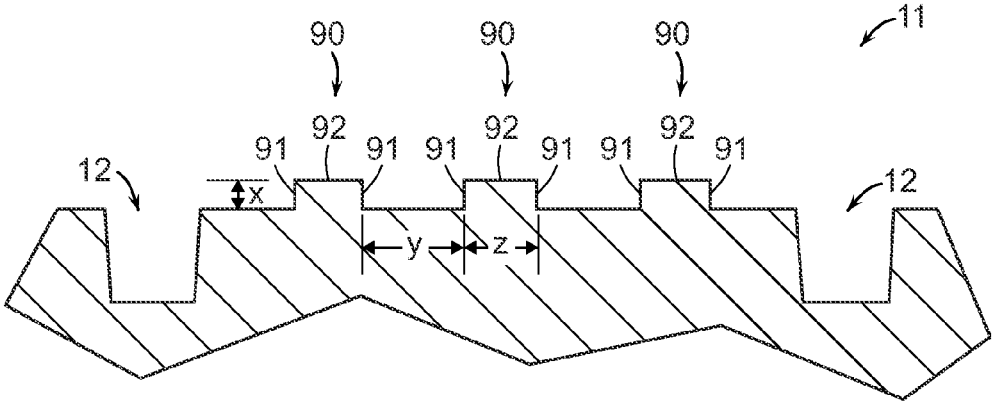

In another embodiment, the golf club includes a plurality of ridges 90 that have a generally rectangular cross-sectional shape, as shown in FIG. 29. Each of ridges 90 generally includes generally orthogonal surfaces 91 and a parallel surface 92 that extends between surfaces 91 to form the generally rectangular ridge 90. Preferably, ridges 90 are spaced by a distance "y" that is between approximately 0.005 and 0.030 inch.

Figure 30:
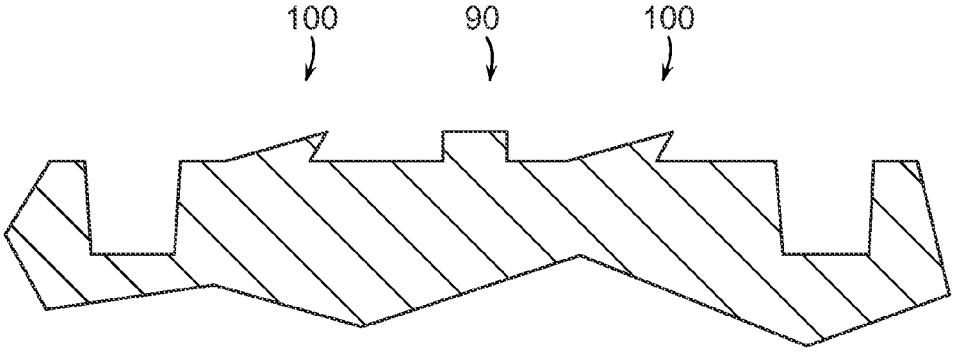
Figure 31:
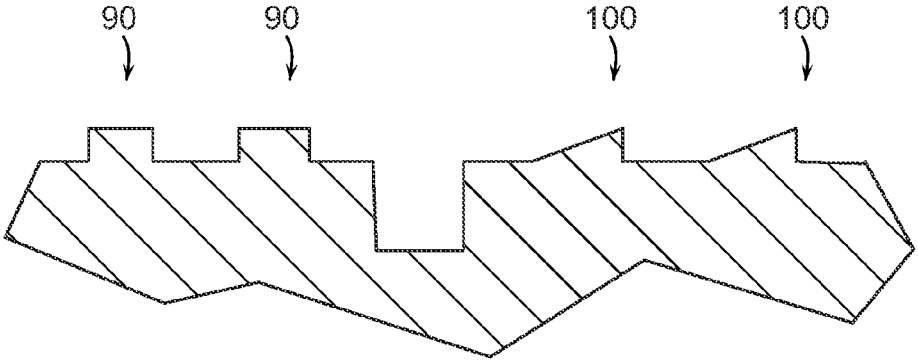

It should further be appreciated that a golf club may be provided with a combination of ridges, such as rectangular and triangular. For example, as shown in FIG. 30, a combination of rectangular ridges 90 and triangular ridges 100 is provided between a pair of adjacent grooves 12. The ridges may have any configuration, such as those described above. In another embodiment, shown in FIG. 31, portions of surface 11 may include ridges having similar configuration, such as a first portion having rectangular ridges 90 and a second portion having triangular ridges 100.

Preferably, the height "x" of the ridges is less than or equal to 0.001 inch and the roughness is from 75 Ra to 300 Ra, more preferably from 100 Ra to 200 Ra, and most preferably from 120 to 180 Ra. Additionally, the width of the ridges "z" is preferably between 0.005 inch and 0.030 inch. Furthermore, the cross-sectional area of each of the ridges is preferably between 0.000005 $inch^2$ and 0.00003 $inch^2$.

Figure 17:
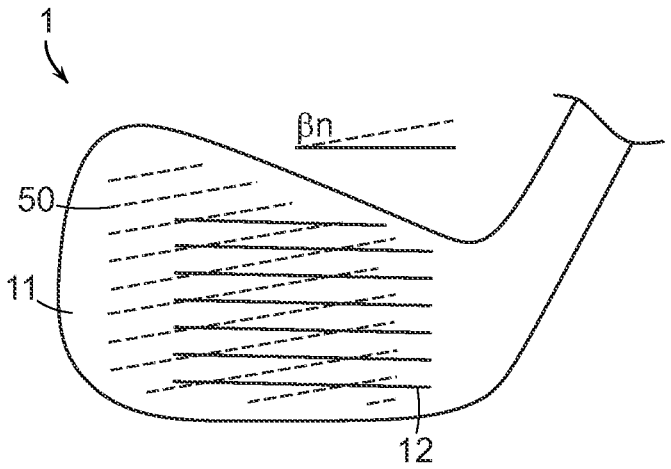

FIG. 17 shows a front view of another club head 1 of the present invention. In this club head 1, the grooves 12 are positioned as with the other embodiments of the invention. The texturing 50 in this embodiment is angled relative the grooves. As with the prior embodiment, the texturing 50 is illustrated with dashed lines with the notches 50 directed perpendicularly relative to the illustration lines. In this illustrated embodiment, the notches 50 are directed in an upper toe to lower heel direction. The angle βn between the grooves 12 and the notches 50 preferably is approximately 5°-30°. It will be noted that the angle reference above the club head 1 illustrated in FIG. 17 is made between an extension of the uppermost notch reference and a horizontal line, parallel to the grooves 12. Another way to say this is that the linear arrangement of notches is angled from approximately 5°-30° relative to the grooves 12. It follows that a vertical projection of the departing surface 51 makes the same angle β with a nominal line perpendicular to the grooves 12. The angled texturing 50 allows the notches 50 to be square to the line of the shot when the club head 1 is opened, such as for a chip shot. This allows the golfer to apply pure backspin (as opposed to including some degree of side spin) to the ball during the swing, even with an opened club head.

Figure 18:
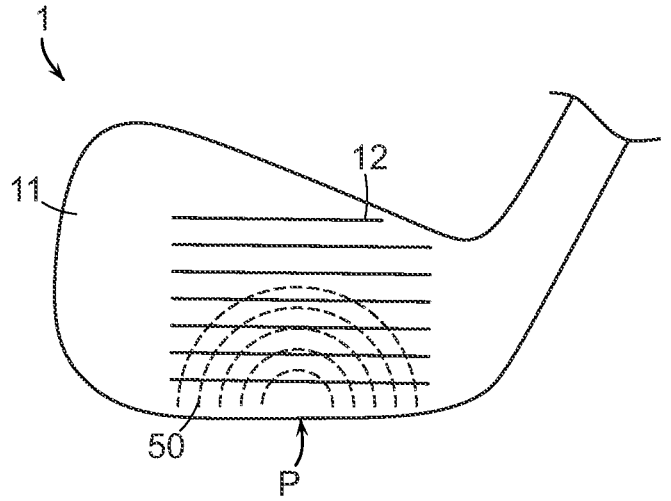

FIG. 18 shows a front view of another club head 1 of the present invention. In this club head 1, the grooves 12 are positioned as with the other embodiments of the invention. Rather than the linear texturing arrangement discussed above, the texturing in this illustrated embodiment is arced or curved. The arcing is centered about at point P that is located at a central portion of the leading edge of the club head 1, preferably in line with the geometric center of the club head 1 and/or its center of gravity. The notches 50 are directed toward point P. While the texturing is only shown in a lower, central region of the face 11, more or less of the face 11 could be textured. For example, the entire face 11 may be textured. Furthermore, while the texturing 50 is shown in the illustrated embodiment of FIG. 18 as being hemispherical, the club head designer could easily create other texture arcs on the face 11. Arced texturing 50 allows the golfer to strike the ball with transverse texturing (that is, with the notches 50 directed in-line with the intended line of ball flight) in numerous club head orientations. However, as the amount of transverse texturing for a particular club head orientation is less with arced texturing 50 than with specifically angled linear texturing (see, for example, FIG. 17), it is contemplated that this set up may be better suited for golfers of high skill level.

Figure 19:
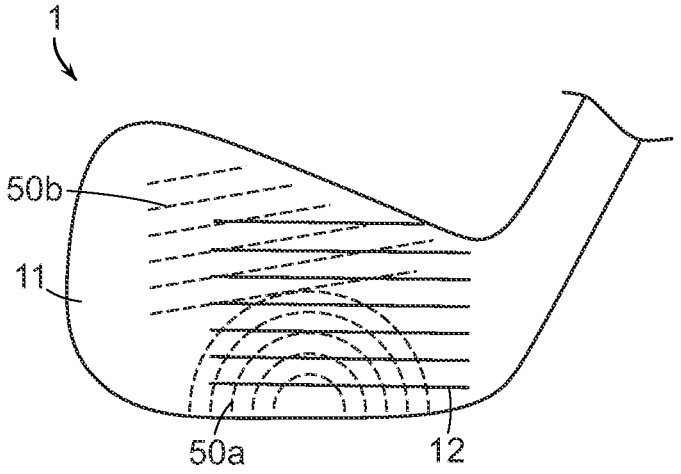

FIG. 19 shows a front view of another club head 1 of the present invention. In this club head 1, the grooves 12 are again positioned as with the other embodiments of the invention. The texturing 50 in this illustrated embodiment is a combination of arced notches 50*a* (see FIG. 18) and angled notches 50*b* (see FIG. 17). The club head 1 thus includes two types of texturing 50*a*, 50*b*. This texturing combination provides the benefits of both of these previously described embodiments. It is possible that there may be some overlap of the different textures 50*a*, 50*b*, perhaps intentionally. A standard milling cutter may be used. To ensure that some amount of both types of texturing are present in the overlapping sections, these areas may be machined with a staggered mill cutter. That is, the milling blades may contain spaces such that some portions of the face are not cut in a single pass of the mill. Alternatively, the overlapped texturing may be specifically programmed into the CNC milling machine.

Figure 20:
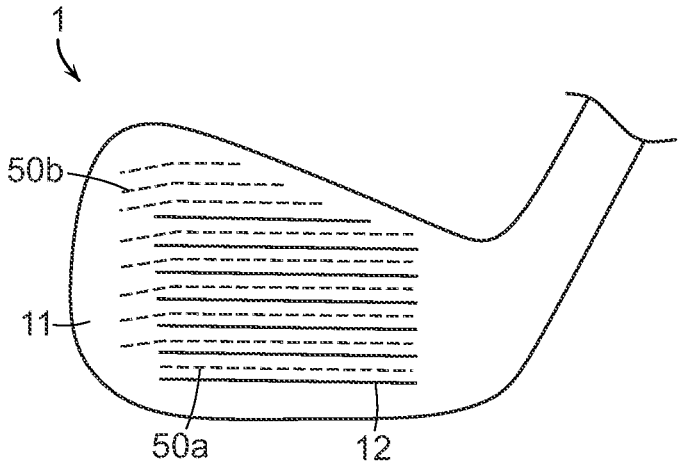

FIG. 20 shows a front view of another club head 1 of the present invention, with the grooves 12 positioned as with the other embodiments of the invention. The texturing 50 in this illustrated embodiment is a combination of the "straight" texturing 50*a* (see FIG. 16) and angled texturing 50*b* (see FIG. 17). Thus, the face 11 contains two distinct sets of directional texturing 50*a*, 50*b*. The texturing 50*a* in the lower and central portions of the face 11 are straight, while the texturing 50*b* in the upper and toe portions of the face 11 are angled. This design provides the golfer with the benefits of having transverse texturing in both square and open club head orientations. The angle between the axes of the sets of directional texturing 50*a*, 50*b* preferably is approximately 5°-25°, with 10°±5° and 20°±5° being more preferred.

Figure 21:
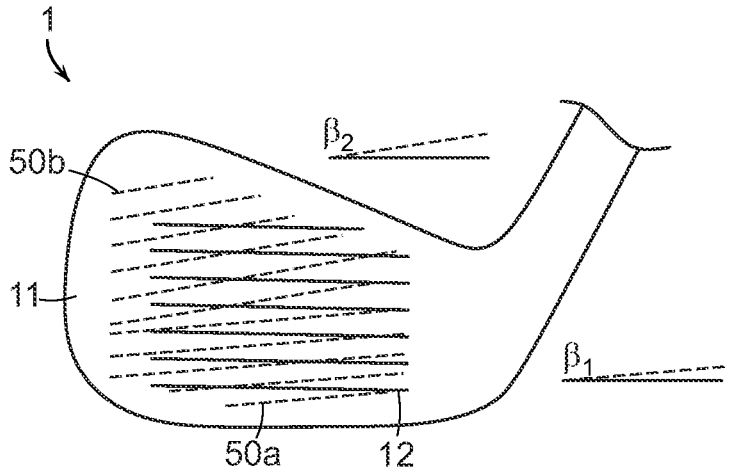

FIG. 21 shows a front view of another club head 1 of the present invention, with two sets of angled notched texturing. A first set of directional texturing 50*a* is angled at a first angle $\beta_1$ relative the grooves 12, and a second set directional texturing 50*b* is angled at a second angle $\beta_2$ relative the grooves 12, with the second angle $\beta_2$ being greater than the first angle $\beta_1$. Similarly to FIG. 17, the first angle $\beta_1$ is made between an extension of a reference line of the first set of directional texturing 50*a* and a horizontal reference parallel to the grooves 12, and the second angle $\beta_2$ is made between an extension of a reference line of the second set of directional texturing 50*b* and the horizontal reference. The first portion of texturing 50*a* is positioned on lower and central regions of the face 11, allowing the golfer to strike the ball with transverse notches 50*a* with a slightly open club head. The second portion of texturing 50*b* is positioned on central and upper regions of the face 11, allowing the golfer to strike the ball with transverse notches 50*b* with a larger degree of club head openness. It will be noted that the greater-angled texturing 50*b* is positioned higher on the face than the less-angled texturing 50*a*. There may be a substantial amount of overlapping among the varying directional texture sets 50*a*, 50*b*. Preferred exemplary ranges for the angles are $5° \leq \beta_1 \leq 15°$ and $15° \leq \beta_2 \leq 25°$.

Figure 22:
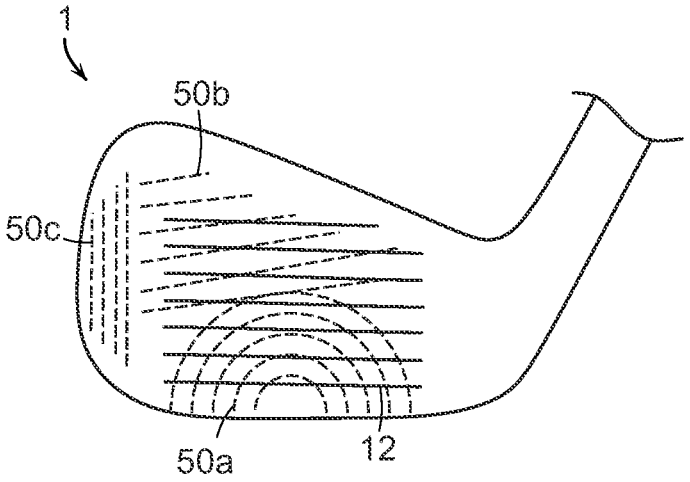

FIG. 22 shows a front view of another club head 1 of the present invention, with three sets of notched texturing. The first set 50*a* is arced texturing (see FIG. 18) and the second set 50*b* is angled linear texturing (see FIGS. 17, 20, and 21) have both been described above. The face 11 further includes a third set of texturing 50*c*. These notches are again angled perpendicularly to the dashed reference lines. The reference lines are substantially perpendicular to the grooves 12, with the notches directed toward the toe 16. This allows the golfer to use the extreme toe portion of the face for a certain style of chipping with the toe pointed toward the playing surface. This inventive directional texture scheme allows the golfer to strike the ball with transverse notches in a great variety of club head orientations.

These are just a few of the preferred directionally textured face embodiments. A skilled artisan could contemplate several additional schemes based on the teachings of this disclosure. Thus, the invention should not be read as limited to the illustrated embodiments presented herein.

Golf club faces are often plated to protect the club head material from environmental factors that may adversely affect the club head, such as by causing it to rust. However, such plating may smooth the surface, effectively canceling the benefit of the textured face of the instant invention. At least a portion of the instant club head face preferably is left raw and not plated. This helps ensure that the benefits of the textured face are realized. Preferably a quarter of the face is raw, and more preferably at least a third of the face is raw. In one preferred embodiment, the entire face is left in a raw condition.

The texturing 50 has been shown in the drawings as dashed lines so that it can be readily distinguished from the grooves 12. This use of dashed lines is solely for the sake of clarity in the illustrated embodiments. This should not be interpreted as an indication that the texturing is hidden. The texturing is provided on the face 11 of the club head 1, and is visible in the finished product. Furthermore, the textured surface is not limited to the areas actually covered by the dashed lines. Rather, only a few lines are shown to indicate the texturing so that the figures do not become too crowded and unreadable. The entire portion of the face 11 in and among the notch reference lines 50 is textured. This portion may include the entire striking face 11, or only a portion of the face 11. Preferably, the inventive golf clubs conform with all USGA regulations.

The golf club head 1 preferably is formed of a soft base metal, such as a soft carbon steel, 8620 carbon steel being an example. A chrome finish may be applied to the base metal to inhibit wear and corrosion of the base metal. If included, the chrome finish preferably includes a non-glare layer. The chrome finish layer preferably has a thickness between 0.005 μin and 280 μin, with 80 μin a preferred thickness. A nickel finish may additionally be applied to the base metal as a sub-layer for chrome or another finish layer or may alternatively be applied to the base metal as the finish layer. If included, the nickel finish preferably has a thickness between 400 μin and 1200 μin, with 800 μin a preferred thickness.

In use, the grooves 12 and strike face 11 of the present invention enhance performance, especially in adverse conditions. The higher friction possible with the golf club head 1 allows a tighter grip on the golf ball during "wet" or "grassy" conditions than was previously possible. The club head of the present invention was tested, and as shown in Table 1 below, the generated revolutions per minute of a struck golf ball were substantially the same as those generated with a conventional club for a full dry shot, but were increased in a half dry shot and in both a full wet shot and a half wet shot. The "dry" shots contained substantially no moisture on the club face and ball. For the "wet" shots, the club face and/or the golf ball surface were sprayed with water in an amount that would be typical for shots made during a round in dewy or rainy conditions. A 60° wedge was used in these tests. Table 1 shows the revolutions per minute of a golf ball after being struck with a standard club or a spin milled club of the present invention, and illustrates the benefit of the spin milled grooves over standard grooves.

TABLE 1

| Shot Conditions | Standard | Spin Milled |
|---|---|---|
| Dry - full | 12250 | 12000 |
| Dry - half | 6500 | 7750 |
| Wet - full | 8000 | 12000 |
| Wet - half | 4000 | 8000 |

A preferred method of making the club head 1 includes first making a club head body. This may be done by casting, forging, or any other manufacturing method. The face is then machined such that it is substantially smooth and flat, preferably flat within ±0.002 inch. This preferably may be done by fly-cutting the face, which is cutting with a single-point tool fixed to the end of an arm protruding from a vertical milling shaft. Having a flat face allows the golfer to achieve consistent results during use. The body preferably is nested during the face flattening process. That is, the body is retained within a housing such that it is substantially immobile. The face is left exposed so that it can be worked on. The housing may be padded or otherwise designed such that it does not damage the club head.

Once the requisite face flatness has been achieved, the grooves are created and the surface is roughened as described above. While it is preferred that the grooves be spin milled prior to roughening the surface, the order of these steps is not essential. In fact, it is possible that they be performed substantially simultaneously, or with at least some amount of overlap.

The spin milled grooves may have very sharp edges, which could have an adverse effect on a golf ball during use. Thus, the grooves may be deburred to remove any sharp edges in the groove-to-face junction. This creates a radius at the junction, the radius preferably being less than 0.01 inch. This deburring can be carried out in a variety of ways. The junction may be filed, such as with a wire brush or a file, such as a carbide file. In conjunction with filing, or as an alternative method, the junction can be deburred by blasting. This may include impacting small beads at the junction at high speeds. To protect the face of the club head, which may have already been roughened above 40 Ra, the face may be masked. Masking includes placing a physical barrier on the face adjacent the grooves such that the projected particles cannot impact the face. Alternatively or in conjunction with masking, a nozzle can be used to accurately direct the projected material only at the junction.

FIGS. 6-9 each show a cross-section of a preferred groove 12 that may be formed by the method described above. The groove 12 includes a first portion 121 adjacent to and interacting with the club face 11. In this illustrated embodiment, the edges of the groove 12 have been deburred, either having a radius or being angled. An angled edge is preferred for the spin milling process described above, and a preferred range of angles $A_1$ is about 10° to 50°. The width $W_1$ of the groove 12 at the strike face 11, which is the widest portion of the groove 12, is about 0.035 inch. This corresponds to the maximum width allowable by the USGA. This width transitions narrower through the first groove portion 121 to a width $W_2$ between about 0.033 and 0.027 inch at the lowermost boundary of the first portion 121. The first portion 121 is shallow, preferably having a depth $D_1$ of less than 0.005 inch, with 0.001 to 0.003 inch being more preferred. The first portions of the illustrated embodiments of FIGS. 6-9 are similar, but extending to varying depths $D_1$. The embodiment illustrated in FIG. 6 has the shallowest depth $D_1$, and the embodiment illustrated in FIG. 7 has the deepest depth $D_1$.

The groove 12 includes a second portion 122 adjacent to the first portion 121. This portion 122 preferably has substantially parallel walls that are substantially perpendicular to the face 11, "substantially" herein meaning the walls may be angled at an angle $A_2$ of up to about 20°. Preferably, the walls defining the second portion 122 are spaced as far apart as possible to maximize the volume of the groove 12. A preferred range of widths $W_2$, $W_3$ is about 0.033 to 0.027 inch. In relative terms, the maximum width $W_2$ of the second portion 122 preferably may be from about 80% to 98% of the maximum groove width $W_1$. Preferably, the width $W_3$ at a bottom portion of the second portion 122 is at least about 80% of the width $W_2$ at a top portion of the second portion 122. A preferred range of depths $D_2$ is between about 0.005 and 0.008 inch. In some preferred embodiments, the second section depth $D_2$ is at least half the overall groove depth D. The overall groove depth D preferably is between about 0.0175 and 0.0225 inch, more preferably about 0.02 inch.

The groove 12 includes a third portion 123 adjacent to the second portion 122. This portion 123 has a V-shape, having an angle $A_3$ of about 90°. Thus, the width of the third portion 123 decreases from the top portion thereof (nearest the face 11) to the bottom portion thereof.

Preferably, the width at the bottom of the third portion is less than about half of the width of the top portion. In some preferred embodiments, the depth $D_3$ of this third section 123 may be from about 0.012 to 0.015 inch. The depth $D_3$ of this third section 123 preferably is at least twice the depth $D_2$ of the second portion 122. In some preferred embodiments, the third portion 123 has a depth $D_3$ that is about 60% to 75% of the overall groove depth D.

The groove 12 includes a fourth portion 124 adjacent to the third portion 123. This portion 124 is radiused to join the walls of the third section 123. A preferred radius $R_4$ is less than 0.012 inch.

Another way to quantify the grooves is by pitch ratio. Pitch ratio P is calculated according to the following formula:

$$P = \frac{A}{W + S}$$

where A is the cross-sectional area of the groove, W is the groove width (measured at the face surface), and S is the spacing between adjacent grooves. The pitch ratio P thus has the units of length/length. The governing bodies of the Rules of Golf have proposed new rules limiting the pitch ratio P to be less than 0.0025 in.$^2$/in.

Figure 10:
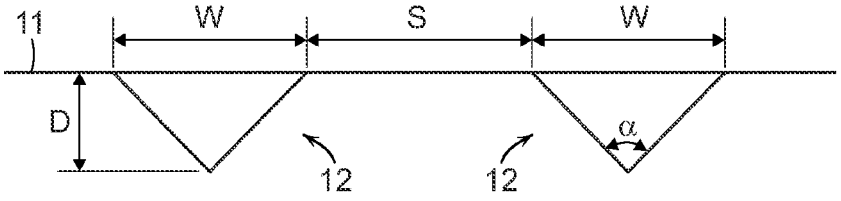
FIG. 10 shows a cross-section of a preferred groove of the present invention.
Figure 11:
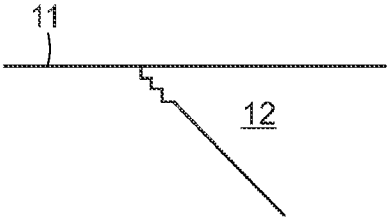
FIG. 11 shows a stepped face-groove junction of the present invention.

FIG. 10 shows a cross-section of a preferred groove 12 that may be formed by the spin mill method described above. The line of the face 11 has been extended across the groove 12 for illustrative purposes. This groove 12 may be referred to as a "V-groove," as the side walls converge from points adjacent the face 11 toward their union at the bottom of the groove 12. This union may be radiused as discussed above. Preferably, the face-groove junctions are deburred to avoid sharp edges that may cut or otherwise damage a golf ball. For example, the groove edges may be radiused or angled. Exemplary angles include the range of 0.005 in. to 0.02 in. The face-groove junctions may also contain a series of steps, each of which may or may not be radiused. A stepped face-groove junction is illustrated in FIG. 11. While three steps are shown in this exemplary embodiment, more or fewer steps could be included. A preferred number of steps include the range of 1 to 10 steps. The use of a stepped face-groove junction may increase the golfer's ability to impart spin to the ball, enhancing the golfer's ability to control the ball flight and landing/settling characteristics. A preferred range for the length of the rise (the "vertical" part of the step) and run (the "horizontal" part of the step) of each step includes the range of 0.0015 in. to 0.01 in. It is preferred that the rise(s) and run(s) be of the same dimension, but they may also be constructed such that the rise is greater than the run or vice versa. Additionally, it is possible that individual rises of a plurality of rises may be of the same or differing values. The runs may also be of similar of dissimilar values. This stepped face-groove junction can be used with any of the grooves described herein.

The maximum allowable groove width W allowed by the Rules of Golf is 0.035 in., and the space S between edges of adjacent grooves must be no less than three times the groove width W and not less than 0.075 in. Additionally, the maximum groove depth D allowed by the Rules of Golf is 0.02 in. Setting the width W to 0.035 in. and the spacing S to 0.105, the only variable in the pitch ratio calculation is the cross-sectional area A. The area A, of course, is a function of the groove depth, groove width, and wall angles. Turning to the grooves illustrated in FIG. 10, the grooves 12 may be characterized by the inclusive angle $\alpha$ formed by the two side walls. (The inclusive angle $\alpha$ is equivalent to twice the draft angle $\beta$.) Preferred values for the inclusive angle $\alpha$ include the range of 85° to 95°, with 90°±3° being more preferred. The depth D of these grooves may be less than 0.02 in. Preferably, the depth D is within the range of 0.015 in. to 0.02 in., 0.015 in. to 0.018 in. being more preferred. This yields a groove area A that is within a preferred range of 0.00026 in$^2$ to 0.00035 in$^2$. And thus the pitch ratio P is approximately 0.0025 in.$^2$/in or less.

Figure 12:
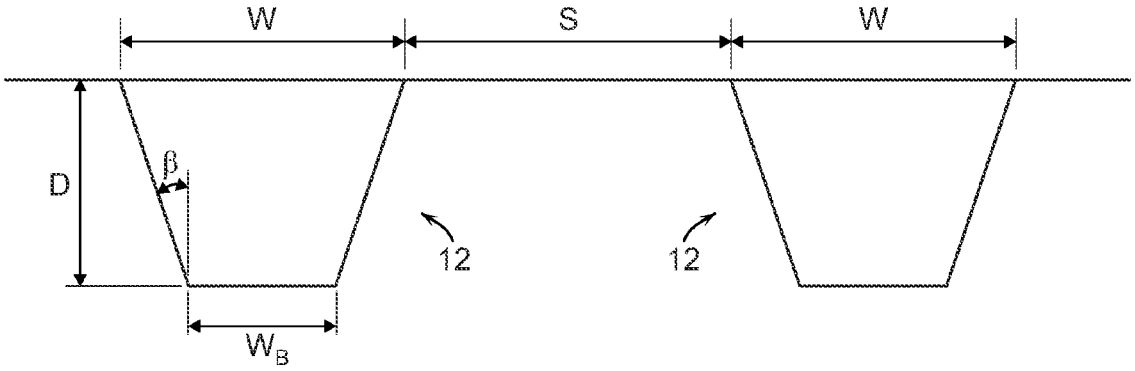
FIGS. 12-14 each show a cross-section of a preferred groove of the present invention.

FIG. 12 shows a cross-section of another preferred groove of the present invention. This illustrated groove is similar to a V-groove, but has a bottom wall such that the side walls do not intersect. These grooves 12 may be characterized by their draft angle $\beta$, which preferably may be within the range of 30° to 40°, 35°±3° being more preferred. Setting the depth D and width W to the maximum allowable dimensions yields an area A of 0.00037 in.$^2$ to 0.00047 in.$^2$, more preferably approximately 0.0004 in$^2$. The width $W_B$ of the bottom wall may also be used to characterize the groove 12. Preferably, the bottom wall width $W_B$ is ⅓ to ⅙ the groove width W, with ¼ to ⅕ being more preferred. Again, preferably the pitch ratio P is approximately 0.0025 in.$^2$/in or less. The junctions between the side and bottom walls may be radiused, in which case the bottom wall width $W_B$ may be measured between intersections of bottom and side wall extensions. That is, the bottom wall width $W_B$ may be measured as if the junctions were not radiused.

Decreasing the draft angle β of the groove 12 illustrated in FIG. 12 modifies its shape such that it may be categorized as a "U-groove." Preferred values for the draft angle β include 12° to 20°, with 16°±2° being more preferred. In this instance, the depth D preferably is less than the maximum allowable, and within the range of 0.018 in. to 0.02 in. Similarly, the width W may be slightly less than the maximum allowable dimension, for example within the range of 0.03 in. to 0.035 in. This yields an area A of approximately 0.0004 in.$^2$ to 0.0005 in.$^2$ Again, preferably the pitch ratio P is approximately 0.0025 in.$^2$/in. or less.

To simplify the groove cross-sectional area and pitch ratio calculations, any steps that may be used to form the face-groove junction may be ignored. Of course, such steps may be taken into account when making the calculations.

Figure 13:
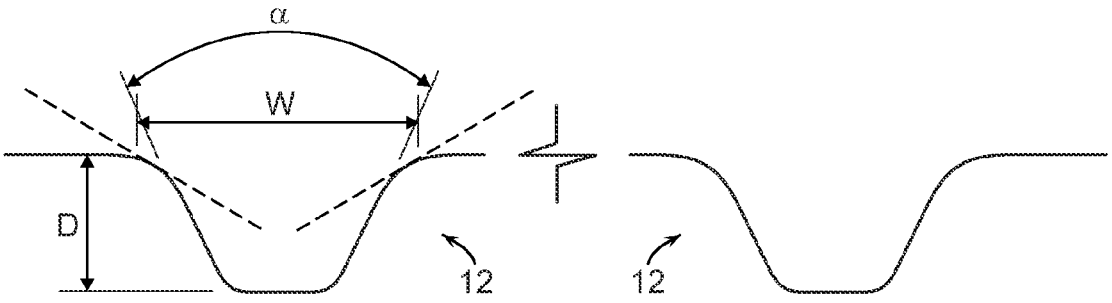

One way to enhance the functionality of the grooves 12 of a golf club head is to increase the volume of the individual grooves. One such preferred groove design is shown in FIG. 13. In this illustrated example, the spacing S is not held to the minimum value and is instead increased, thus allowing an increased area A and still yielding pitch ratio P values within the preferred range. The inclusive angle α formed by the side walls preferably is within the range of 50° to 55°, with 52°±1° being more preferred. The groove width W preferably is maximized to 0.035 in., but 0.032 in.±0.002 in. is also preferred. Similarly, while the depth D preferably is maximized to 0.02 in., 0.017 in.±0.002 in. is also preferred. This yields a groove area A that is within the range of 0.00035 in.$^2$ to 0.00039 in.$^2$, taking into consideration the fact that the face-groove junctions and the side wall-bottom wall junctions are all radiused. Increasing the groove spacing S above the minimum allowable to 0.175 in. to 0.185 in., with 0.179 in.±0.002 in. being more preferred, yields a pitch ratio P that is less than 0.0025 in.$^2$/in., and approximately equal to 0.0021 in.$^2$/in. Expanding upon this idea, the spacing S may be further increased above the minimum value to, for example, 0.2 in. or 0.25 in.

Figure 14:
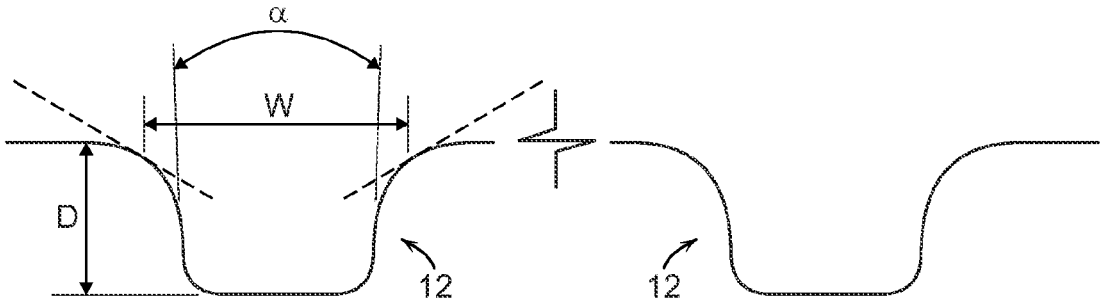

FIG. 14 illustrates another groove 12 of increased volume. Here, again, the spacing S is increased above the minimum allowed value. The inclusive angle α formed by the side walls preferably is within the range of 2° to 10°, with 4°±1° being more preferred. This gives the groove 12 a U-shape. The groove width W preferably is maximized to 0.035 in., but 0.032 in.±0.002 in. is also preferred. Similarly, while the depth D preferably is maximized to 0.02 in., 0.017 in.±0.002 in. is also preferred. This yields a groove area A that is within the range of 0.00039 in.$^2$ to 0.00043 in.$^2$, again taking into consideration the fact that the face-groove junctions and the side wall-bottom wall junctions are all radiused. These dimensions yield a pitch ratio P that is less than 0.0025 in.$^2$/in., and approximately equal to 0.0021 in.$^2$/in. The bottom wall width $W_B$ may be 80% to 95% of the groove maximum width W measured at the strike face 11.

Recitation of ranges of values herein are merely intended to serve as a shorthand method of referring individually to each separate value falling within the range, unless otherwise indicated herein, and each separate value is incorporated into the specification as if it were individually recited herein.

As used herein, directional references such as rear, front, lower, bottom, upper, top, etc. are made with respect to the club head when grounded at the address position. See, for example, FIG. 1. The direction references are included to facilitate comprehension of the inventive concepts disclosed herein, and should not be read or interpreted as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body having a striking face including a plurality of grooves extending into the body from the striking face and at least one region of texturing, wherein the region of texturing is interposed between adjacent grooves and includes at least a first ridge and a second ridge, wherein each ridge extends uninterrupted in a generally heel to toe direction, wherein each of the ridges includes a first surface extending away from a nominal striking face plane to a second surface, the second surface extending between the first surface and the nominal striking face plane, wherein the first surface is oriented relative to the second surface by an apex angle, and wherein the apex angle of the first ridge is different than the apex angle of the second ridge.

2. The golf club head of claim 1, wherein the apex angles of the ridges reduce in the direction of a top line from a leading edge.

3. The golf club head of claim 1, wherein the length of the first surface is equal to the length of the second surface in one of the first and second ridges.

4. The golf club head of claim 1, wherein the apex angle of the first ridge is an acute angle.

5. The golf club head of claim 1, wherein the apex angle of the first ridge is a right angle.

6. The golf club head of claim 1, wherein the apex angle of the first ridge is an obtuse angle.

7. A golf club head, comprising:

a body having a striking face including a plurality of grooves extending into the body from the striking face and at least one region of texturing, wherein the region of texturing is interposed between adjacent grooves and includes at least a first ridge, a second ridge and a third ridge, wherein each ridge extends uninterrupted in a generally heel to toe direction, wherein the first ridge, the second ridge and the third ridge are consecutive ridges, and wherein the pitch of the ridges changes in the space between the adjacent grooves such that the length of space between the first and second ridges is different than the length of the space between the second and third ridges.

8. The golf club head of claim 7, wherein each of the plurality of ridges includes a first surface extending away from a nominal striking face plane to a second surface, the second surface extending between the first surface and the nominal striking face plane, such that the plurality of ridges have a triangular cross-sectional shape.

9. The golf club head of claim 8, wherein the length of the first surface is equal to the length of the second surface.

10. The golf club head of claim 8, wherein the first surface is oriented relative to the second surface by an acute angle.

11. The golf club head of claim 8, wherein the first surface is oriented relative to the second surface by a right angle.

12. The golf club head of claim 8, wherein the first surface is oriented relative to the second surface by an obtuse angle.

13. The golf club head of claim 7, wherein the region of texturing includes a plurality of ridges having a rectangular cross-sectional shape and the ridges have a width of 0.005 inch to 0.030 inch and wherein the ridges are spaced by 0.005 inch to 0.030 inch.

14. The golf club head of claim 13, wherein the region of texturing further comprises a plurality of ridges having a triangular cross-sectional shape.

15. A golf club head, comprising:

a body having a striking face including a plurality of grooves extending into the body from the striking face and a region of texturing, wherein the region of texturing includes at least a first ridge and a second ridge, wherein each ridge extends uninterrupted in a generally heel to toe direction, wherein the region of texturing includes a plurality of ridges having a rectangular cross-sectional shape and a plurality of ridges having a triangular cross-sectional shape.

16. The golf club head of claim 15, wherein the rectangular ridges have a width of 0.005 inch to 0.030 inch.

17. The golf club head of claim 15, wherein the rectangular ridges are spaced by 0.005 inch to 0.030 inch.

18. The golf club head of claim 15, wherein each of the plurality of triangular ridges includes a first surface extending away from a nominal striking face plane to a second surface, the second surface extending between the first surface and the nominal striking face plane, wherein the first surface is oriented relative to the second surface by an acute angle.

19. The golf club head of claim 18, wherein the length of the first surface is equal to the length of the second surface.

20. The golf club head of claim 15, wherein each of the plurality of triangular ridges includes a first surface extending away from a nominal striking face plane to a second surface, the second surface extending between the first surface and the nominal striking face plane, wherein the first surface is oriented relative to the second surface by a right angle.

* * * * *